US006581987B1

(12) United States Patent
Gentile et al.

(10) Patent No.: US 6,581,987 B1
(45) **Date of Patent: *Jun. 24, 2003**

(54) HOOD LATCH MECHANISM WITH IN-LINE STRIKER SPRING

(75) Inventors: William Robert Gentile, Pontiac, MI (US); Jason Allen Beauchamp, Pellston, MI (US); Martin J. Wortmann, Clarkston, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 5 days.

This patent is subject to a terminal disclaimer.

(21) Appl. No.: 09/713,372

(22) Filed: Nov. 15, 2000

(51) Int. Cl.[7] ..... E05C 3/06
(52) U.S. Cl. ..... 292/216; 292/DIG. 14
(58) Field of Search ..... 292/216, DIG. 14, 292/DIG. 23, DIG. 43, DIG. 56, DIG. 72, DIG. 73

(56) References Cited

U.S. PATENT DOCUMENTS 2,646,299 A * 7/1953 Karamer ..... 292/44
3,743,335 A * 7/1973 Reihac ..... 292/127
4,917,417 A * 4/1990 Aubry ..... 292/117
5,046,768 A 9/1991 Myslicki
5,048,877 A * 9/1991 Rogers, Jr. et al. ..... 292/110
5,150,933 A * 9/1992 Myslicki et al. ..... 292/216
5,172,945 A * 12/1992 Doherty et al. ..... 292/49
5,618,069 A 4/1997 Konchan et al.
6,149,210 A * 11/2000 Hunt et al. ..... 292/216

* cited by examiner

*Primary Examiner*—Gary Estremsky
(74) *Attorney, Agent, or Firm*—Casimir R. Kiczek; Richard M. Mescher

(57) ABSTRACT

A latching mechanism for selectively retaining a closure having a striker is provided that includes a housing forming a vertically extending groove for receiving the striker, first and second axles located on opposite sides of the groove, a striker spring located at the groove, a pawl pivotable about the first axle and defining a notch, and a ratchet pivotable about the second axle and defining a protrusion adapted to cooperate with the notch of the pawl to selectively retain the ratchet in a locked position. The ratchet defines a pocket for receiving the striker and retaining the striker in the groove when the ratchet is in the locked position. The housing is adapted to accept an over slam force from the striker at a bottom end of the groove. Preferably, the striker spring is substantially in-line with a path of the striker into the groove.

20 Claims, 11 Drawing Sheets

HOOD LATCH MECHANISM WITH IN-LINE STRIKER SPRING

FIELD OF THE INVENTION

The present invention generally relates to a latching mechanism and, more particularly, to a latching mechanism for retaining a closure of a motor vehicle compartment in a closed or latched position.

BACKGROUND OF THE INVENTION

Vehicles such as passenger cars, light and heavy duty trucks, tractor trailers, buses, commercial delivery vehicles, among other motorized forms of transportation are conventionally equipped with latched closures for controlling access to one or more compartments of the vehicle. Examples of such closures for compartments include hoods, trunk lids, fuel doors, among others. Conventional latches provide adequate access to the vehicle compartment but have several deficiencies. First, the latches typically have a large number of parts. Second, the latches are typically designed for a hood having a particular size and weight. Third, the latches often fail when the closure is "over slammed", that is, closed with too much force. Fourth, vehicle hoods must be designed with crowns to put tension on the latch and prevent rattle during operation of the vehicle.

One example of a latch for a hood is illustrated in copending and commonly assigned U.S. patent application Ser. No. 09/516,748 (Wortmann et al.), the disclosure of which is expressly incorporated herein in its entirety by reference. The latch disclosed therein is adapted to transmit an "over slam" force directly to the vehicle structure and not through the housing of the latch so that the housing can be formed from plastic.

Accordingly, there is a need in the art for a latching mechanism which can be utilized on a wide range of hood sizes, weights and dimensions, can accept an "over slam" force directly through the housing, and does not require a crown on the closure to prevent rattle.

SUMMARY OF THE INVENTION

The present invention provides a latching mechanism for a vehicle which overcomes at least some of the above-noted problems of the related art. According to the present invention, a latching mechanism for selectively retaining a closure having a striker is provided that comprises, in combination, a housing forming a vertically extending groove for receiving the striker, first and second axles located on opposite sides of the groove, a striker spring located at the groove, a pawl pivotable about the first axle and defining a notch, and a ratchet pivotable about the second axle and defining a protrusion adapted to cooperate with the notch of the pawl to selectively retain the ratchet in a locked position. The ratchet also defines a pocket for receiving the striker and retaining the striker in the groove when the ratchet is in the locked position. The housing is adapted to accept an over slam force from the striker at a bottom end of the groove. In a preferred embodiment of the invention, the striker spring is substantially in-line with a path of the striker into the groove.

According to another preferred embodiment of the present invention, the striker spring is positioned at the groove to directly engage the striker, particularly when the ratchet is in the locked position. With the striker spring adapted to directly engage the striker in the locked position, the latching mechanism can be utilized with vehicle closures not having a crown without having rattle problems during operation of the vehicle.

According to another aspect of the present invention, a latching mechanism for selectively retaining a closure having a striker is provided that comprises, in combination, a housing forming a vertically extending groove for receiving the striker, first and second axles located on opposite sides of the groove, a striker spring located at the groove, a pawl pivotable about the first axle and defining a notch, and a ratchet pivotable about the second axle and defining a protrusion adapted to cooperate with the notch of the pawl to selectively retain the ratchet in a locked position. The ratchet also defines a pocket for receiving the striker and retaining the striker in the groove when the ratchet is in the locked position. The latching mechanism is also provided with a first stop attached to the ratchet that is adapted to cooperate with the housing to limit rotation of the ratchet upon downward movement of the striker in the groove and a second stop attached to the ratchet that is adapted to cooperate with the housing to limit rotation of the ratchet upon upward movement of the striker out of the groove.

According to yet another aspect of the present invention, a latching mechanism for selectively retaining a closure having a striker is provided that comprises, in combination, a housing forming a vertically extending groove for receiving the striker, first and second axles located on opposite sides of the groove, a striker spring located at the groove, a pawl pivotable about the first axle and defining a notch, and a ratchet pivotable about the second axle and defining a protrusion adapted to cooperate with the notch of the pawl to selectively retain the ratchet in a locked position. The ratchet also defines a pocket for receiving the striker and retaining the striker in the groove when the ratchet is in the locked position. The latching mechanism is also provided with spring members biasing the pawl and the ratchet in opposite directions of rotation.

From the foregoing disclosure and the following more detailed description of various preferred embodiments it will be apparent to those skilled in the art that the present invention provides a significant advance in the technology and art of latching mechanisms. Particularly significant in this regard is the potential the invention affords for providing a latching mechanism which can be utilized on a wide range of hood sizes, weights and dimensions, can accept an "over slam" force directly through the housing, and does not require a crown on the closure to prevent rattle. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
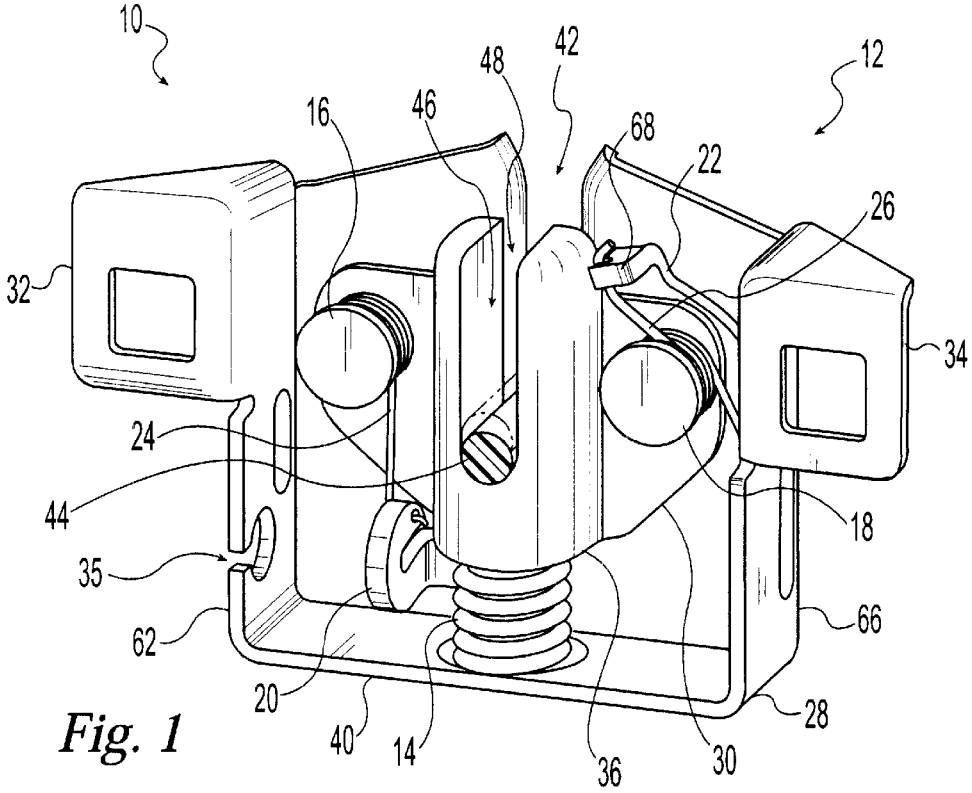
FIG. 1 is a perspective view of a hood latch mechanism with an in-line striker spring according to the present invention shown in a latched position and shown with a striker in two positions.
Figure 2:
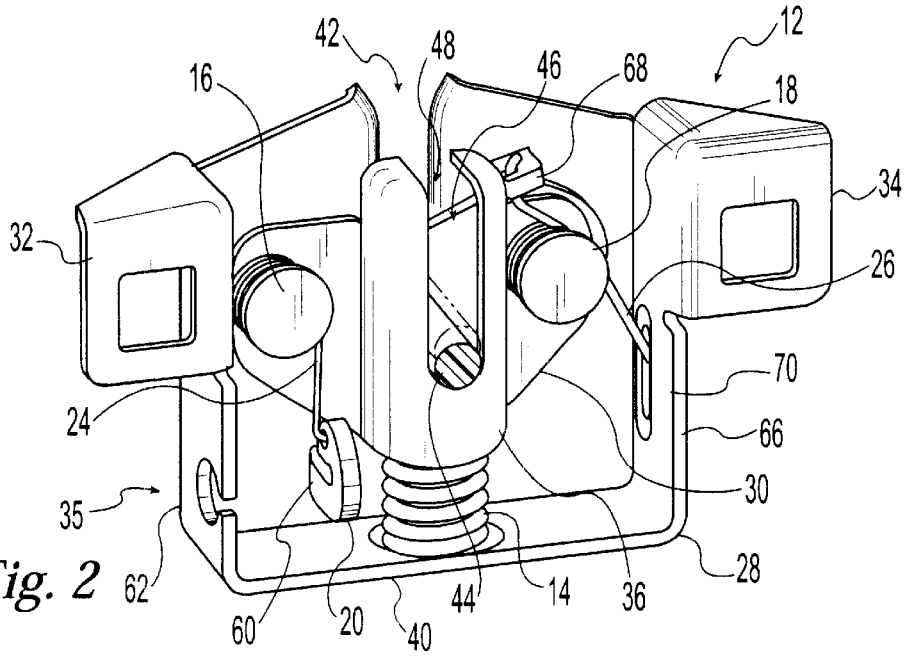
FIG. 2 is a perspective view of the adjustable hood latch mechanism of FIG. 1 shown from a different angle.
Figure 3:
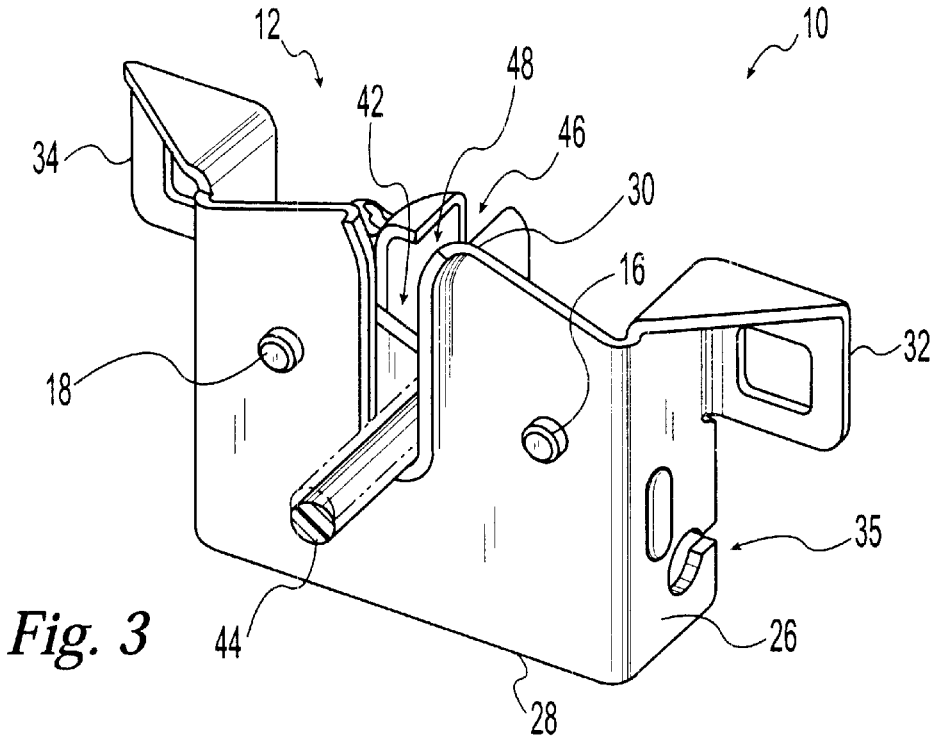
FIG. 3 is a perspective view of the hood latch mechanism of FIG. 1 shown from the other side of the hood latch mechanism.
Figure 4:
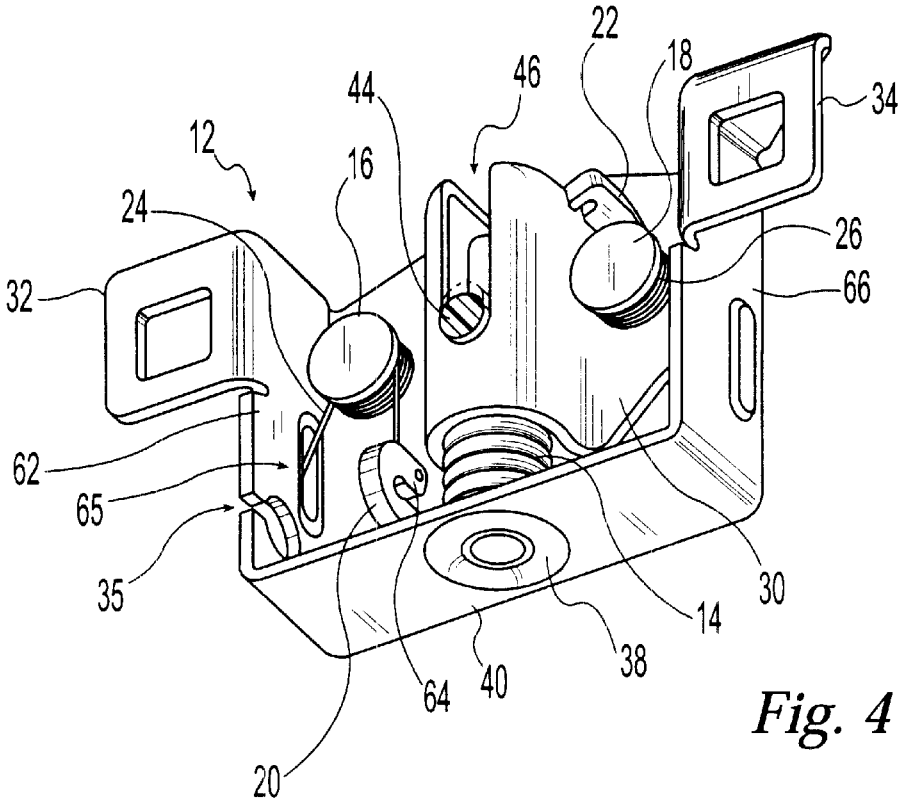
FIG. 4 is a perspective view of the hood latch mechanism of FIGS. 1–2 shown from a different angle.
Figure 5:
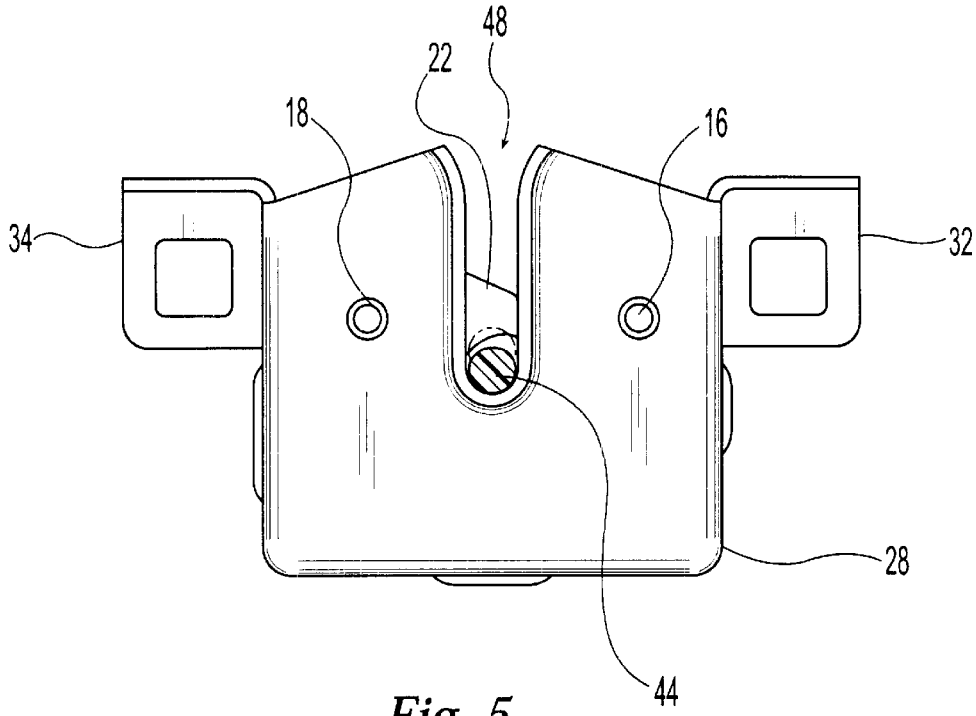
FIG. 5 is a front view of the hood latch mechanism of FIG. 1.
Figure 6:
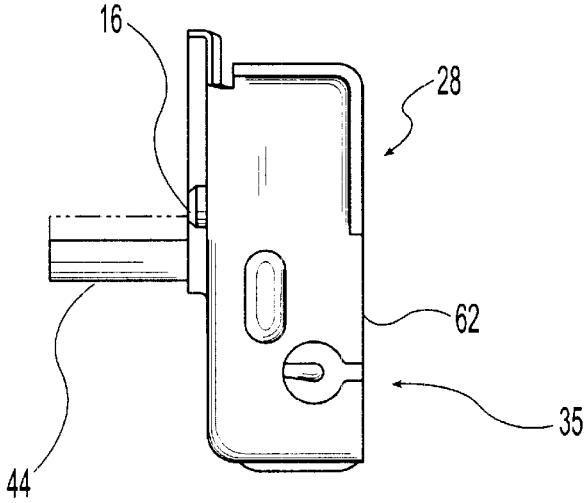
FIG. 6 is side view of the hood latch mechanism of FIG. 1.
Figure 7:
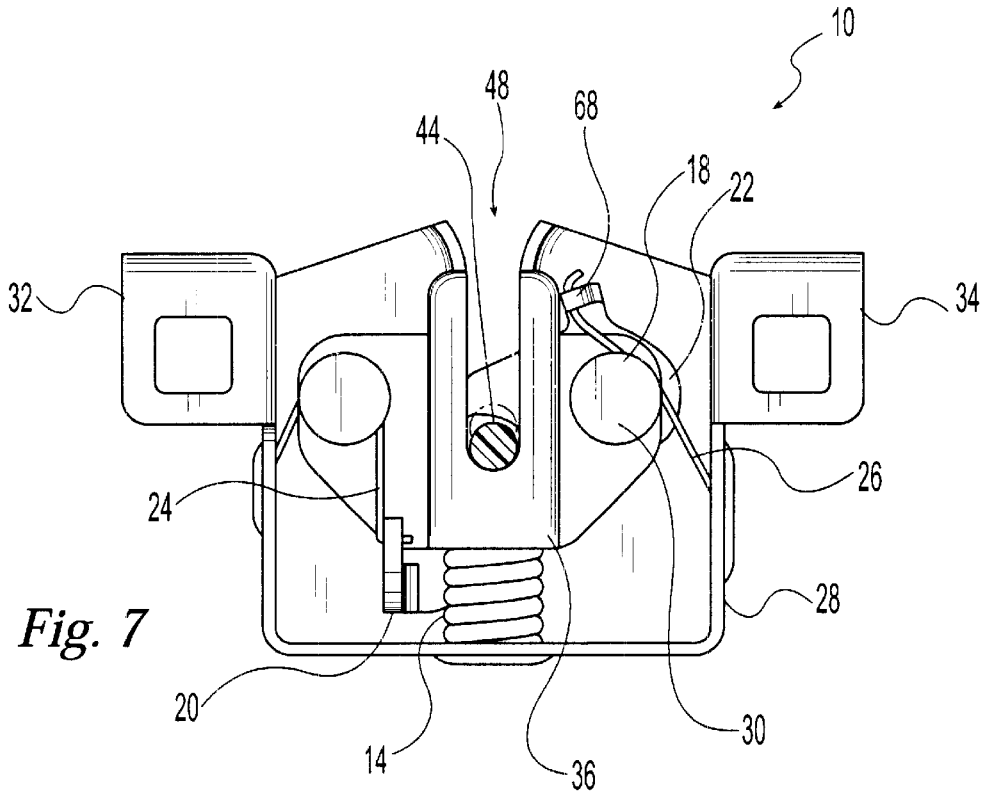
FIG. 7 is a rear view of the hood latch mechanism of FIG. 1.
Figure 8:
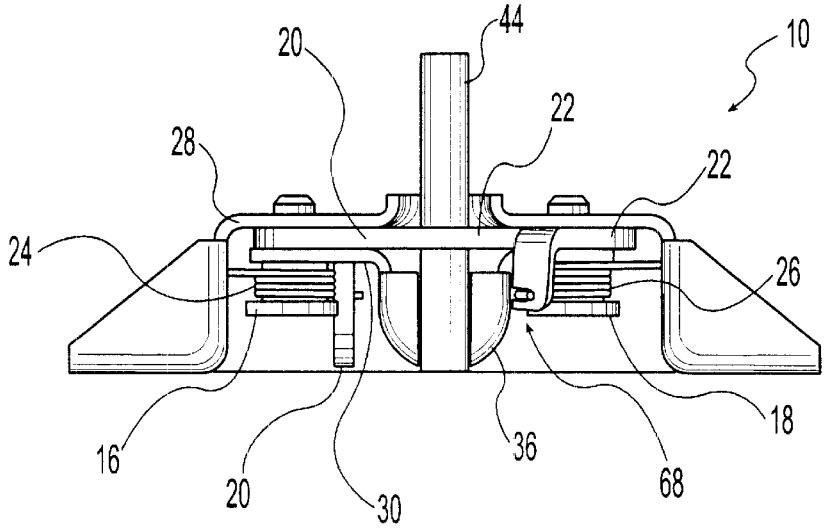
FIG. 8 is a top view of the hood latch mechanism of FIG. 1.
Figure 9:
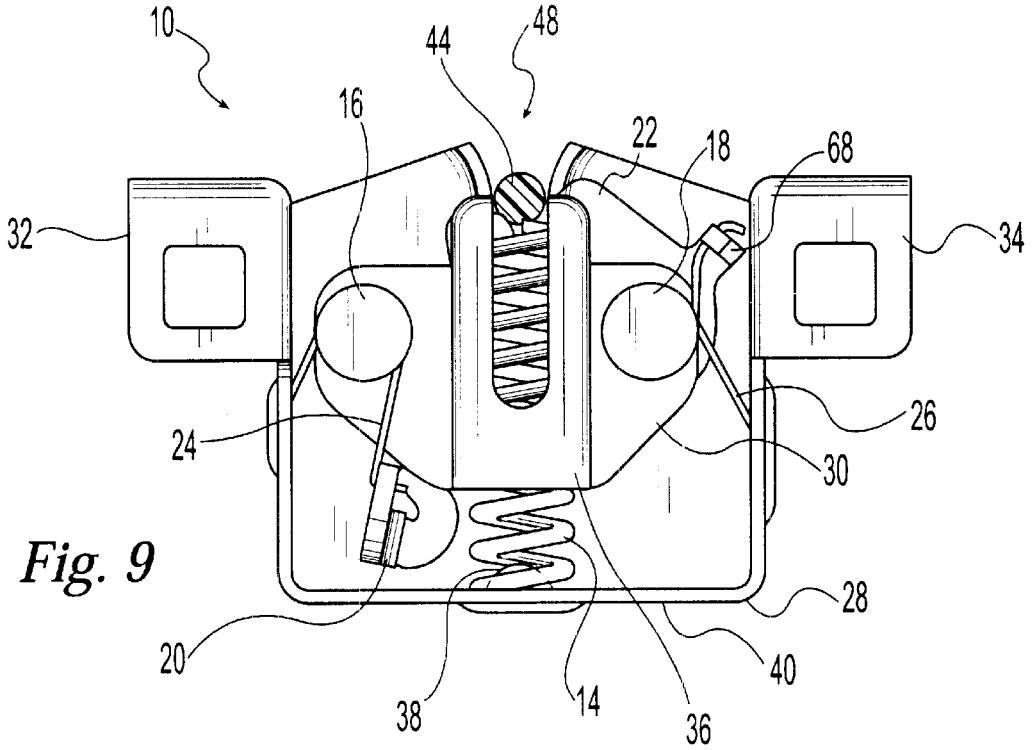
FIG. 9 is a front view of the hood latch mechanism of FIG. 1 shown in an unlatched position, shown with the pawl in a released position, and shown with the striker in one position.
Figure 10:
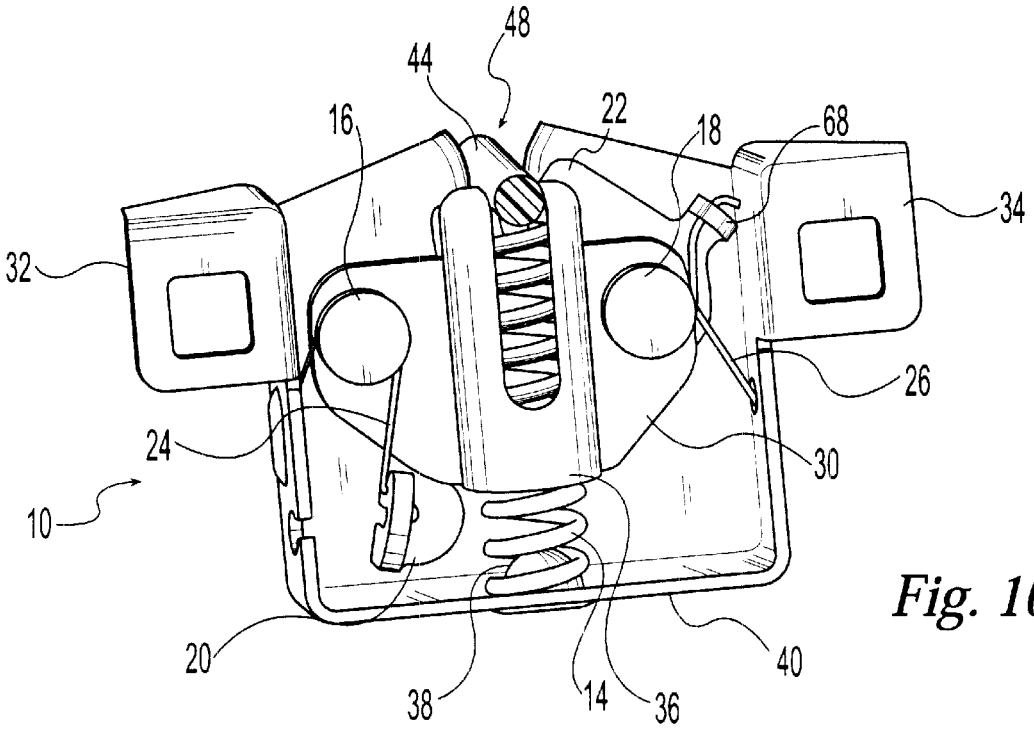
FIG. 10 is a perspective view of the hood latch mechanism of FIG. 9 shown with the pawl in a released position.
Figure 11:
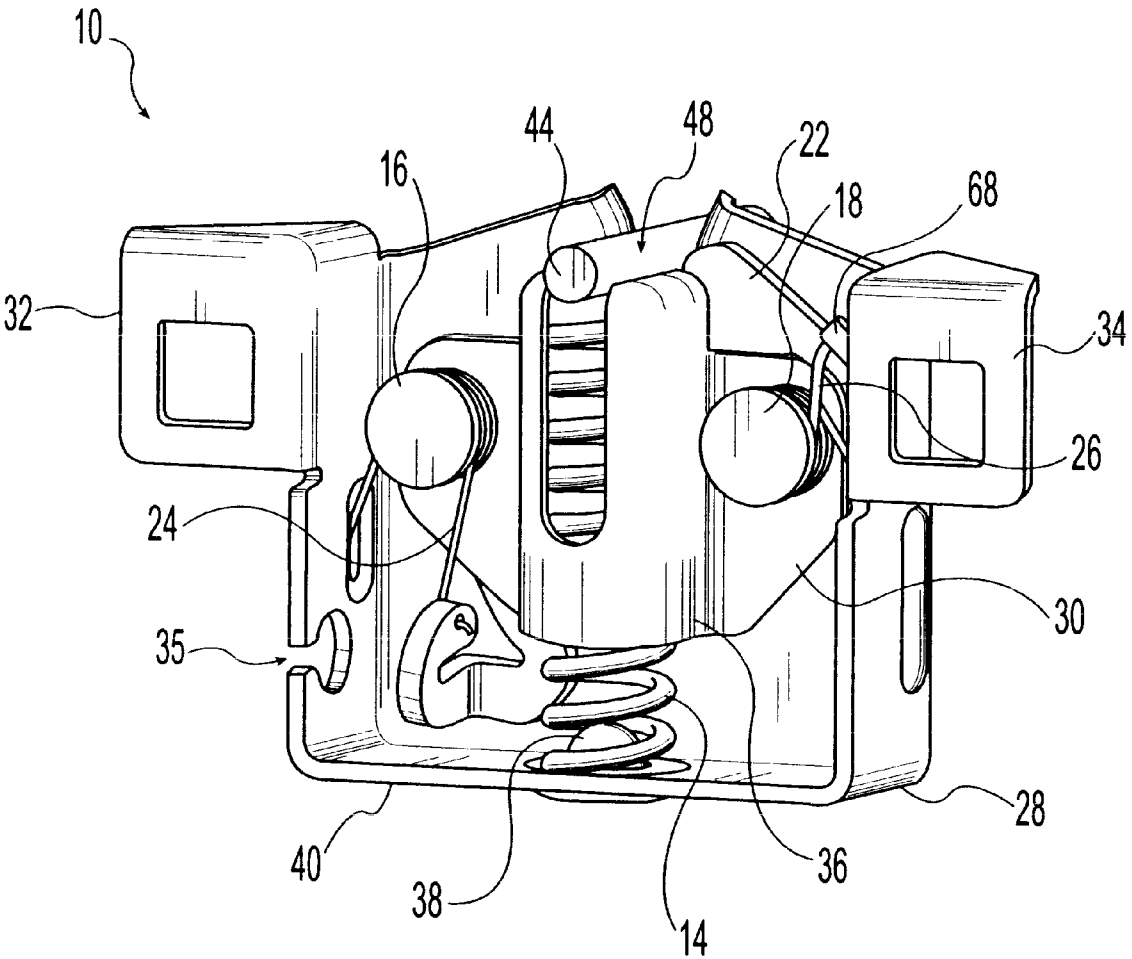
FIG. 11 is a perspective view of the hood latch mechanism of FIG. 10 shown from a different angle and shown with the pawl in a released position.

It should be understood that the appended drawings are not necessarily to scale, presenting a somewhat simplified representation of various preferred features illustrative of the basic principles of the invention. The specific design features of a latching mechanism as disclosed herein, including, for example, specific shapes of the pawl and ratchet will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the latching mechanism illustrated in the drawings. In general, up or upward refers to an upward direction in the plane of the paper in FIGS. 12–14 and down or downward refers to a downward direction in the plane of the paper in FIGS. 12–14.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved latching mechanism disclosed herein. The following detailed discussion of various alternative and preferred embodiments will illustrate the general principles of the invention with reference to a latching mechanism for use with a motor vehicle. Other embodiments suitable for other applications will be apparent to those skilled in the art given the benefit of this disclosure.

Referring now to the drawings, FIGS. 1–17 illustrate a latching mechanism 10 for a hood of a motor vehicle, such as an automobile, according to the present invention. While the illustrated embodiments of the present invention are particularly adapted for use with an automobile, it is noted that the present invention can be utilized with any vehicle having a compartment with a closure including trucks, buses, vans, recreational vehicles, earth moving equipment and the like, off road vehicles such as dune buggies and the like, air borne vehicles, and water borne vehicles.

FIGS. 1–14 illustrate a first preferred embodiment of the invention. The latching mechanism 10 comprises a housing 12, a striker spring 14, a pair of axles or support rivets 16, 18 for pivotally supporting components, a pawl 20, a ratchet 22, and a pair of spring members 24, 26 for biasing the pawl 20 and the ratchet 22 about the rivets 16, 18.

The housing 12 comprises a mounting bracket 28 and a support plate 30 fixedly attached to the mounting bracket 28 by the rivets 16, 18. The mounting bracket 28 defines a pair of holes (not shown) that are laterally spaced apart and are sized and shaped to support the rivets 16, 18 therein. The mounting bracket 28 defines means for securing a pawl actuator (not shown) such as, for example, a cable actuator and defines means for attaching the latching mechanism 10 to a vehicle, such as, for example, flanges 32, 34 defining openings for fastening means. Fastening means (not shown) for attaching the latching mechanism 10 to a vehicle can be any suitable means such as, for example, at least one conventional bolt, carriage bolt, or other suitable fastener known in this art. The illustrated mounting bracket 28 also defines an opening 35 adapted to secure the conduit of a Bowden or "push-pull" cable for serving as a pawl actuator.

The support plate 30 defines means for supporting the striker spring 14. In the preferred embodiment, support plate 30 forms a vertically extending cylinder portion 36 adapted to support the striker spring 14. The illustrated striker spring 14 is helical-coil wire compression spring. A retaining cap or protrusion 38 (FIGS. 9–11) is provided on a bottom or lower wall 40 of the mounting bracket 28 that cooperates with the support plate 30 to retain the striker spring 14 between the support plate 30 and the mounting bracket 28. The retaining cap or protrusion 38 may be a protrusion formed in the bottom wall 40 of the mounting bracket 28, may be a retaining cap that is removable from the lower wall 40 to assist in assembly or replacement of the striker spring 14, or may be any other retaining means that supports the striker spring 14 alone or in cooperation with the support plate 30.

The mounting bracket 28 defines a first vertically extending terminal channel or groove 42 for receiving a striker 44 or other securing member secured to the closure of the vehicle compartment. The cylinder portion 36 of the support plate 30 preferably defines a second vertically extending terminal channel or groove 46 that has a parallel longitudinal axis and is coterminous with the first groove 42. Together, the first 42 and second 46 grooves cooperate to form a third vertically extending terminal channel or groove 48 for receiving the striker 44 or other securing member secured to the closure of the vehicle compartment.

The grooves 42, 46, 48 are open at their upper ends for receiving the striker 44 as the striker 44 moves in a generally downward direction. As illustrated in FIGS. 1–2 and 10–11, the striker spring 14 is adjacent the first groove 42 of the mounting bracket 28 and is adjacent the second groove 46 of the support plate 30. The striker spring 14 is both adjacent the third groove 48 (because the striker spring 14 continues below the third groove 48) and at the third groove 48 (except when the latch mechanism is in an "over slam" position where the striker spring 14 is moved below the third groove 48, more fully discussed below). As the striker 44 enters and travels downwardly in the third groove 48, the striker 44 engages the striker spring 14 with a compressive force which compresses the striker spring 14. The compressive force is a function of the weight/velocity of the downwardly traveling compartment closure to which the striker 44 is attached. As the striker 44 moves downwardly in the third groove 48, it also causes the ratchet 22 to pivot as described in more detail hereinafter.

The rivets 16, 18 are sized and shaped to support the pawl 20 and the ratchet 22 and to form parallel axes of rotation 50, 52 (FIGS. 12–14) for the pawl 20 and the ratchet 22. The rivets 16, 18 are preferably inserted into or affixed to the mounting bracket 28.

Figure 12:
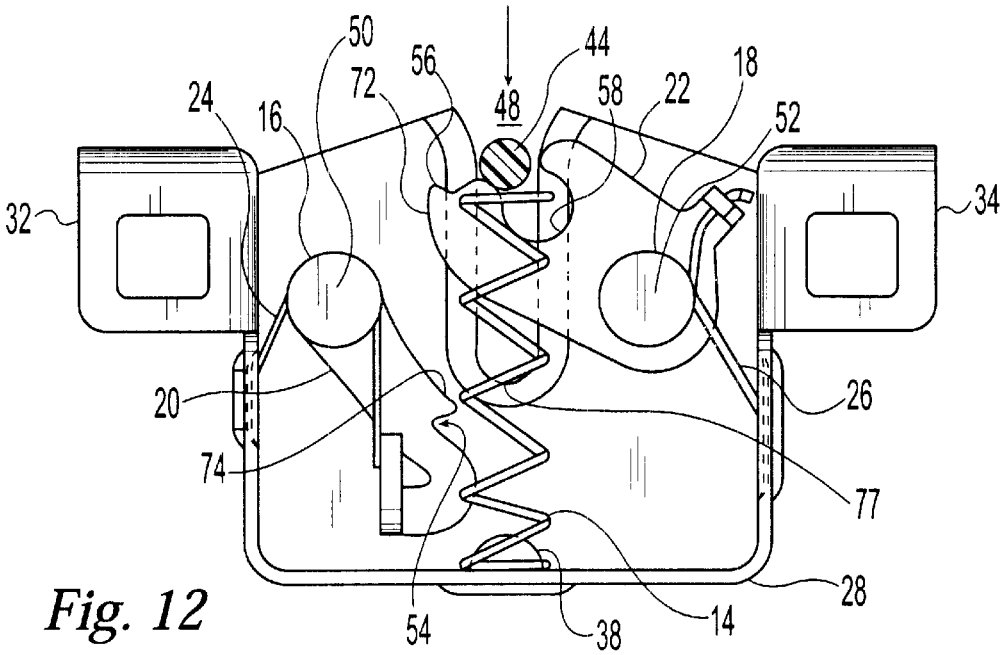
FIG. 12 is a rear elevational view of the hood latch mechanism of FIGS. 1–11 shown without the support plate and shown in an unlatched position.
Figure 13:
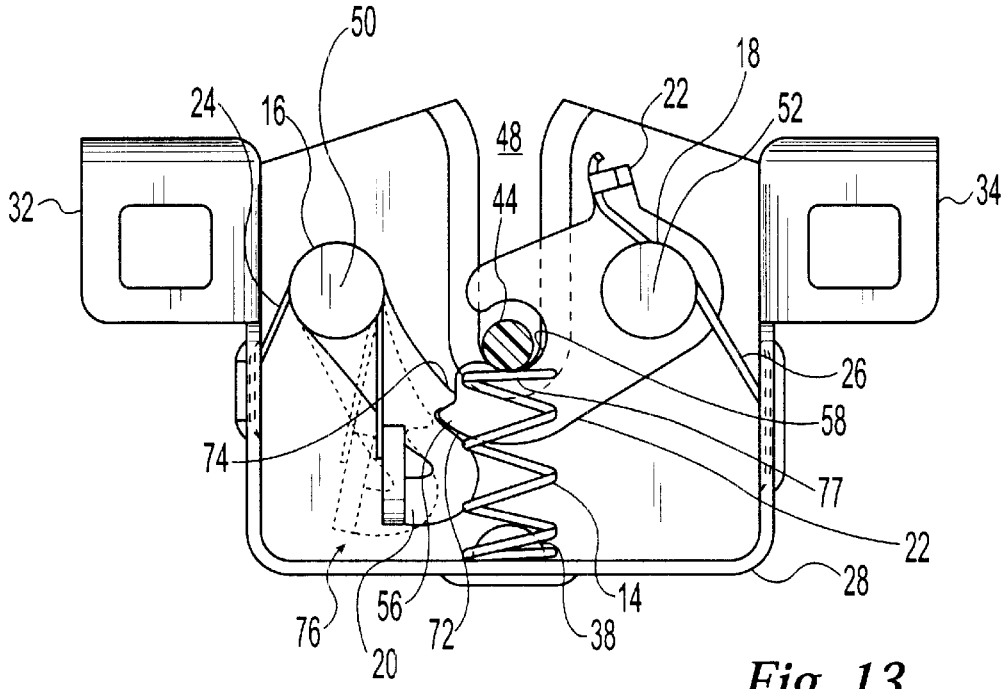
FIG. 13 is a rear elevational view of the hood latch mechanism of FIG. 12 shown without the support plate and shown in a latched position.
Figure 14:
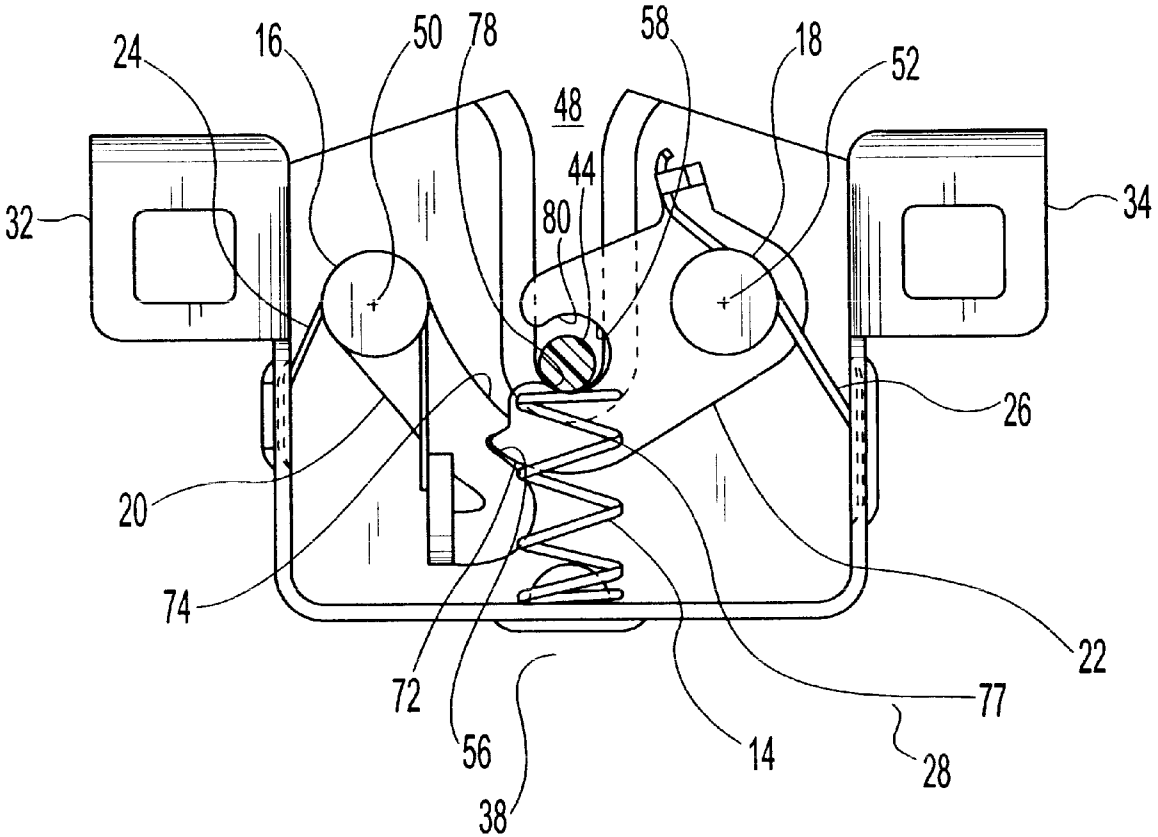
FIG. 14 is a rear elevational view of the hood latch mechanism of FIG. 13 shown without the support plate and shown in an over slam position.

As best illustrated in FIGS. 12–14, the pawl 20 and the ratchet 22 are pivotally mounted on opposite ones of the rivets 16, 18 so that they are generally coplanar. The pawl 20 can be of any suitable configuration so long as the pawl 20 defines a notch or mating surface 54 for receiving a protuberance 56 defined by the periphery of the ratchet 22 that cooperates with the notch 54 to secure the ratchet 22 in a locked position. The ratchet 22 defines the protuberance 56 for cooperating with the pawl 20 and a notch or pocket 58 for receiving the striker 44 and cooperating with the striker 44 to secure the striker 44 within the latching mechanism 10 when the ratchet 22 is in the locked position. The pawl notch 54 functions to maintain the ratchet 22 in a locked position and the ratchet pocket 58 functions to maintain the striker 44 within the latching mechanism 10.

The pawl 20 is also adapted for cooperation with the pawl actuator. The illustrated pawl 20 defines an opening 60 (FIG. 2) adapted to secure the core wire of a Bowden or "push-pull" cable. With the pawl actuator attached to the pawl 20, operation of the pawl actuator pivots the pawl 20 about the first rivet 16 to a release position 76 (shown in phantom in FIG. 13) to disengage the ratchet protuberance 56 from the pawl notch 54 so that the ratchet 22 may pivot about the second rivet 18 and release the striker 44 from the ratchet pocket 58. The striker 44 is propelled upward by the compressed striker spring 14, releasing the compressive force stored in the striker spring 14 when the striker 44 entered the groove 48. It should be appreciated that while the pawl 20 is typically actuated manually by conventional push or pull cable systems, the pawl 20 can be alternatively actuated by electronic or magnetic means. The location of the control device of the pawl actuator can be at any desired location of the vehicle, e.g., underneath the dash, within a door opening, among other locations.

The first and second spring members 24, 26 are adapted to bias the pawl 20 and the ratchet 22 in a desired manner. The illustrated spring members 24, 26 are wire torsion springs, each having two legs or wire ends which provide force in opposite directions. The first spring member 24 is mounted about the first rivet 16 and has one end connected to the pawl 20 and the other end connected to a first side wall 62 (FIG. 1) of the mounting bracket 28. The illustrated first spring member 24 is connected to the pawl 20 by extending into an opening 64 (FIG. 4) formed in the pawl 20 and is connected to the first side wall 62 by extending into a channel 65 (FIG. 4) formed in the first side wall 62 of the mounting bracket 28. The first spring member 24 biases the pawl 20 in a counterclockwise direction (as viewed in FIGS. 12–14) about the first rivet 16. The second spring member 26 is mounted about the second rivet 18 and has one end connected to the ratchet 22 and the other end connected to a second side wall 66 of the mounting bracket 28. The illustrated second spring member 26 is connected to the ratchet 22 by extending into a channel formed in a flange 68 (FIG. 2) of the ratchet 22 and is connected to the second side wall 66 by extending into a channel 70 (FIG. 2) formed in the second side wall 66 of the mounting bracket 28. The second spring member 26 biases the ratchet 22 in a clockwise direction (as viewed in FIGS. 12–14) about the second rivet 18.

FIGS. 12–14 illustrate operation of the latching mechanism 10. FIG. 12 illustrates the latching mechanism 10 in an unlatched position wherein the striker 44 is shown to be travelling downward toward the third groove 48. As the striker 44 enters and travels into the groove 48, the striker 44 engages the upper end of the striker spring 14 and compresses the striker spring 14. The striker 44 also engages the pocket 58 of the ratchet 22 and pivots the ratchet 22 in counterclockwise direction (as viewed in FIG. 12) about the second rivet 18 to a position which retains the striker 44 within the latching mechanism 10.

As the striker 44 moves downward in the third groove 48, a lower edge 72 of the ratchet 22 contacts an upper edge 74 of the pawl 20. The lower edge 72 of the ratchet 22 acts as a carn to rotate the pawl 20 in a clockwise direction (as viewed in FIGS. 12–13) to the release position 76 (shown in phantom in FIG. 13) so that the protuberance 56 of the ratchet 22 moves past the upper edge 74 of the pawl 20. The first spring member 24 then rotates the pawl 20 in a counterclockwise direction (as viewed in FIG. 13) about the first rivet 16 until the notch 54 of the pawl 20 engages the ratchet protuberance 56 so that the pawl 20 retains the ratchet 22 in the locked or latched position.

FIG. 13 illustrates the latching mechanism 10 in the latched position. The striker 44 is biased upward in the groove 48 by the compressed striker spring 14. The striker 44 is retained in position by the pocket 58 of the ratchet 22. The ratchet 22 is biased in a clockwise direction (as viewed in FIG. 13) about the second rivet 18 by the compressed striker spring 14 and the second spring member 26. The ratchet 22 is retained in position by the notch 54 of the pawl 20. The pawl 20 is biased in the counterclockwise direction (as viewed in FIG. 13) about the first rivet 16 by the first spring member 24. The ratchet 22 is released from the previously described locked position by overcoming the bias of the first spring member 24 and pivoting the pawl 20 away from the ratchet 22 to the release position 76 shown in phantom in FIG. 13.

The operator selectively operates the pawl actuator when it is desired to open the closure of the vehicle compartment. When the pawl actuator is operated, the pawl 20 pivots in a clockwise direction (as viewed in FIG. 13) about the first rivet 16 until pawl notch 54 is clear of the ratchet protuberance 56. When the ratchet protuberance 56 is free of the pawl notch 54, the upward force of the striker spring 14 rotates the ratchet 22 in a clockwise direction (as viewed in FIG. 13) and moves the striker 44 upward from the ratchet's pocket 58. The striker 44 is biased upward in the groove 48 by the compressed striker spring 14. The amount of spring force supplied by the striker spring 14 is dependent upon spring force of the striker spring 14.

Figure 15:
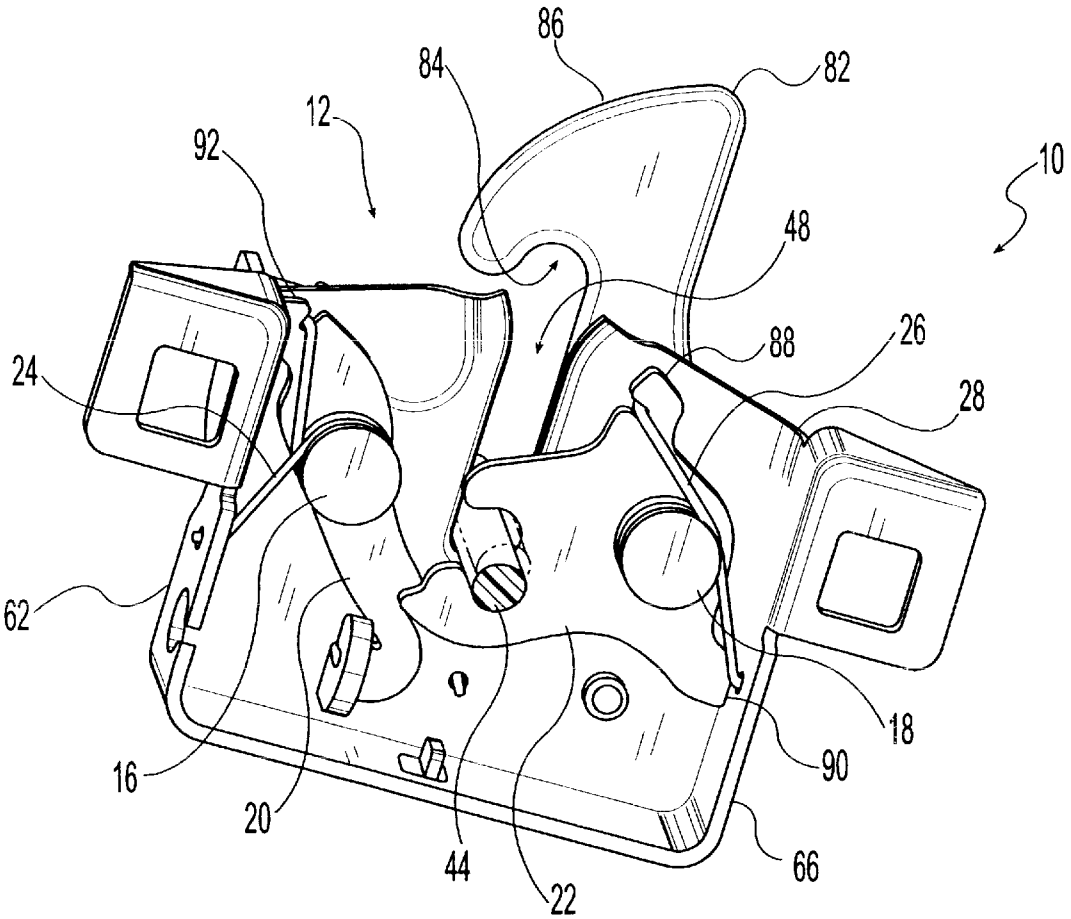
FIG. 15 is a perspective view of an alternative embodiment of a partially assembled hood latch mechanism according to the present invention shown without the striker spring and support plate, shown in a latched position, and shown with a striker in two positions.
Figure 16:
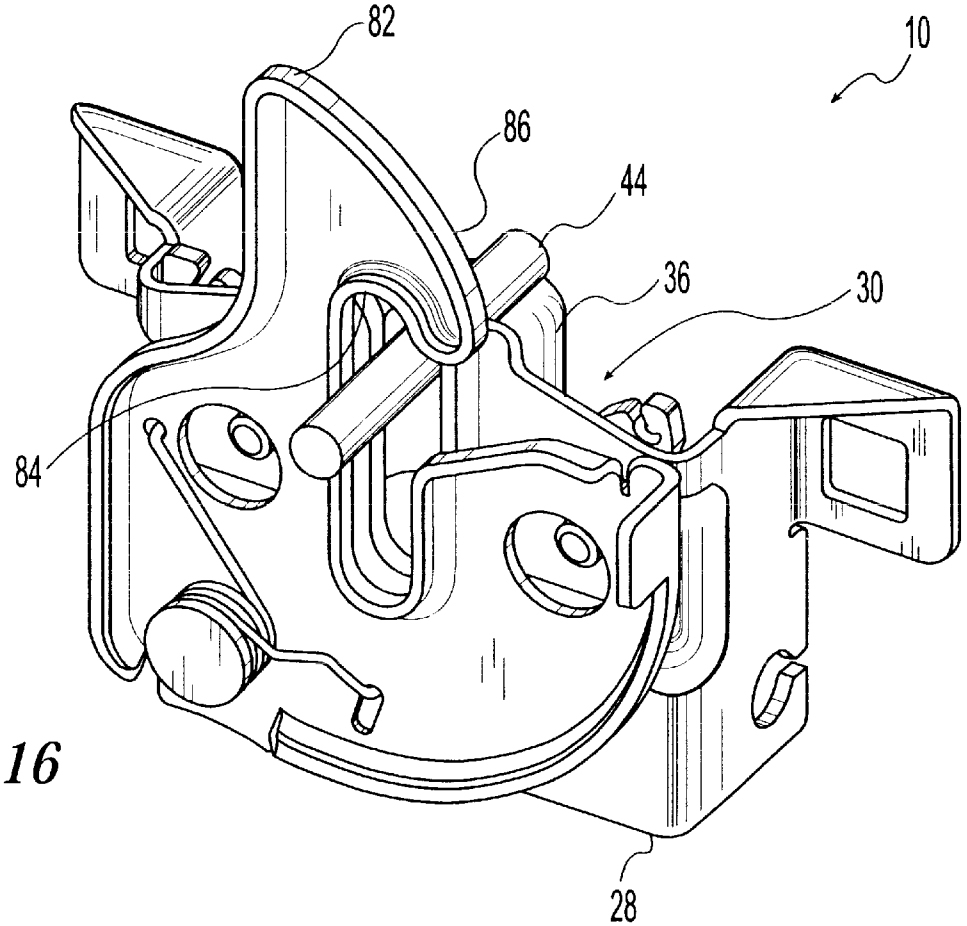
FIG. 16 is a perspective view of the hood latch mechanism of FIG. 15 shown from the opposite side and shown in an unlatched position with the striker in one position.
Figure 17:
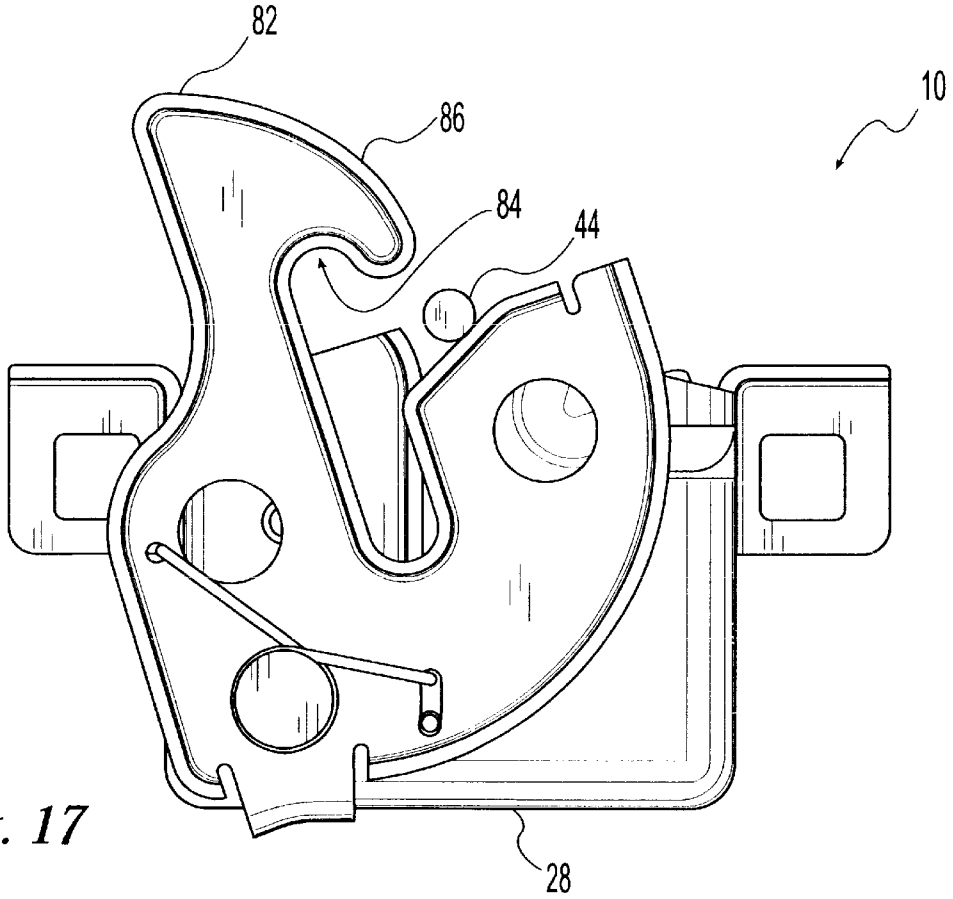
FIG. 17 is a front view of the hood latch mechanism of FIG. 16 shown with the hook in a release position.

FIG. 14 illustrates the latching mechanism 10 in an "over-slam" position. When moving from the unlatched position (FIG. 12) to the latched position (FIG. 13), the striker 44 is moving downwardly into the groove 48 as described above. This downward movement may be with more force than needed to move to the latching position. The additional or "over slam" force causes the striker 44 to travel downwardly until the striker 44 contacts the housing 12 at a bottom end 77 of the third groove 48. The bottom end 77 of the third groove 48 preferably comprises the coterminous ends of the first groove 42 of the mounting bracket 28 and the second groove 46 of the support plate 30. The housing 12 absorbs the full impact of the over slam and transmits the force through the housing 12 to the vehicle through the fasteners attached to the flanges 32, 34. Once the impact is absorbed, the striker 44 begins to travel back upwardly due to the force of compressed striker spring 14. The pocket 58 of the ratchet 22 has opposed abutments 78, 80 limiting upward and downward movement of the striker 44 when the ratchet 22 is in the locked position. In the preferred embodiment, the distance between the abutments 78, 80 is greater than the diameter of the striker 44 so that the striker 44 is movable between the abutments 78, 80 while the ratchet 22 remains in a latched position. FIGS. 1–7 show the striker 44 with a generally round cross section in a first position where the striker 44 is contacting the upper abutment 80 (FIG. 14) and a second position where the striker 44 is contacting the lower abutment 78 (FIG. 14). FIGS. 15–17 illustrate another preferred embodiment of the invention. Parts analogous to those in the first preferred embodiment illustrated in FIGS. 1–14 are indicated by the same numerals. In the alternative preferred embodiment, the latching mechanism 10 comprises a housing 12, a striker spring 14 (not shown), a pair of axles or support rivets 16, 18 for pivotally supporting components, a pawl 20, a ratchet 22, and a pair of spring members 24, 26 for biasing the pawl 20 and the ratchet 22 about the rivets 16, 18. The alternative preferred embodiment also includes a hook 82 pivotally mounted on the mounting bracket 28 that acts as a secondary latch for catching the striker 44 when the ratchet 22 releases the striker 44 as described above in connection with the first preferred embodiment.

The hook 82 includes a catch 84 which blocks the striker 44 from completely exiting the latching mechanism 10 when the striker 44 is released from the ratchet 22. As a result, the striker 44 is partially released and the closure of the vehicle compartment is ajar. The striker 44 is fully released when the hook 82 is pivoted to a release position shown in FIG. 17. The hook 82 includes a camming edge 86 that is engaged by the striker 44 when the striker 44 is moved downward toward the latching mechanism 10 from above the hook 82. The striker 44 pivots the hook 82 to its release position thereby allowing the striker 44 to proceed toward the third groove 48.

As best illustrated in FIG. 15, the alternative preferred embodiment of the invention includes rotation stops 88, 90 on the ratchet 22 and rotation stop 92 on the pawl 20. The rotation stops 88, 90, 92 cooperate with the side walls 62, 66 of the mounting bracket 28 to limit the rotational movement of the ratchet 22 and the pawl 20. The rotation stop 92 of the pawl 20 limits the rotational movement of the pawl 20 in a counterclockwise direction (as viewed in FIG. 15) so that the pawl 20 is maintained in a desired position to cooperate with the protrusion of the ratchet 22. The rotation stops 88, 90 on the ratchet 22 limit rotation of the ratchet 22 upon upward and downward movement of the striker 44 in the third groove 48. The alternative preferred embodiment is also provided with retaining means for cooperating with the support plate 30 (FIG. 16) for supporting the striker spring 14.

The latching mechanism 10 of the present invention can be utilized on a wide range of hood sizes, weights and dimensions because striker springs with different spring forces can be used in the latching mechanism 10 for different vehicles. The latch responds to a given hood and applies a release force (so-called "pop-up") that is appropriate for the hood. The release force is obtained by the striker spring 14 that is compressed by the hood striker upon entering the latching mechanism 10. The striker spring 14 is generally centrally located (as viewed in FIGS. 8 and 9) in the housing 12 and in the third groove 48, which advantageously increases the efficiency and power output of the latching mechanism 10 in releasing the striker 44, thereby allowing for latching mechanisms with reduced size.

It should be appreciated from the above description that the latching mechanism 10 of the present invention can be located in a wide range of locations. For example, the latching mechanism 10 can be employed with forward or rearward opening hoods. It should be noted, however, that normally the latching mechanism 10 is advantageously positioned so that a longitudinal axis of the striker spring 14 is substantially in-line with the path of the striker 44 into the third groove 48 of the latching mechanism 10.

It is apparent from the foregoing description that the latching mechanism 10 of the present invention solves problems associated with conventional latching mechanisms by having relatively few internal moving components. Furthermore, the orientation of the latching mechanism 10 relative to the striker 44 as well as the operation of the latching mechanism 10 provide greater design flexibility in vehicular components that are associated with the latching mechanism 10. The latching mechanism 10, especially due to the in-line orientation of the striker spring 14, advantageously obviates the need for a crown or ridge typically employed for reinforcing the hood, reduces rattles by having a spring force directly acting on the striker 44, implements a standardized hood latch for a wide range of vehicles by allowing striker springs with varying spring forces to be interchanged in the same latch, minimizes any frictional losses of the "pop-up" force from the striker spring, and provides over slam protection by having a housing 12 which absorbs the full impact of an over slammed striker 44.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the pawl 20 and the ratchet 22 can have many different forms. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A latching mechanism for selectively retaining a closure having a striker, the latching mechanism comprising, in combination:

a housing forming a vertically extending groove for receiving the striker, the housing being adapted to accept an over slam force from the striker at a bottom end of the groove;

first and second axles located on opposite sides of the groove;

a striker spring located at the groove;

pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

a first spring member biasing the pawl in a first direction of rotation and a second spring member biasing the ratchet in a second direction of rotation which is opposite the first direction of rotation; and wherein the striker spring is directly engaged by the striker when the striker is in the pocket and the ratchet is in the locked position so that the striker spring moves the striker along the groove to pivot the ratchet out of the locked position against the bias of the second spring member when the protrusion is disengaged from the notch.

2. The latching mechanism of claim 1 wherein the striker spring is substantially in-line with a path of the striker into the groove.

3. The latching mechanism of claim 2 wherein the striker spring is a helical coil compression spring.

4. The latching mechanism of claim 1 wherein the housing comprises a mounting bracket and a support plate attached to the mounting bracket, the support plate adapted to support the striker spring.

5. The latching mechanism of claim 4 wherein a bottom wall of the mounting bracket cooperates with the support plate to support the striker spring.

6. The latching mechanism of claim 1 further comprising a first stop attached to the ratchet and adapted to directly engage the housing to limit rotation of the ratchet upon downward movement of the striker in the groove.

7. The latching mechanism of claim 6 further comprising a second stop attached to the ratchet and adapted to directly engage the housing to limit rotation of the ratchet upon upward movement of the striker out of the groove.

8. The latching mechanism of claim 1 wherein the pocket of the ratchet has opposed abutments limiting upward and downward movement of the striker when the ratchet is in the locked position.

9. The latching mechanism of claim 1 wherein the axles are substantially parallel and spaced apart on opposite sides of the groove.

10. A latching mechanism for selectively retaining a closure having a striker, the latching mechanism comprising, in combination:

a housing forming a vertically extending groove for receiving the striker, the housing being adapted to accept an over slam force from the striker at a bottom end of the groove;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

wherein the housing comprises a mounting bracket and a support plate attached to the mounting bracket, the support plate adapted to support the striker spring; and wherein the support plate forms a cylinder portion for supporting the striker spring.

11. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

a first stop attached to the ratchet and adapted to directly engage the housing to limit rotation of the ratchet upon downward movement of the striker in the groove; and a second stop attached to the ratchet and adapted to directly engage the housing to limit rotation of the ratchet upon upward movement of the striker out of the groove.

12. The latching mechanism of claim 11 wherein the striker spring is substantially in-line with a path of the striker into the groove.

13. The latching mechanism of claim 12 wherein the striker spring is a helical coil compression spring.

14. The latching mechanism of claim 11 wherein the housing comprises a mounting bracket and a support plate attached to the mounting bracket, the support plate adapted to support the striker spring.

15. The latching mechanism of claim 11 further comprising spring members biasing the pawl and the ratchet in opposite directions of rotation.

16. A latching mechanism for selectively retaining a closure having a striker, the latching mechanism comprising, in combination:

a housing forming a vertically extending groove for receiving the striker;

first and second axles located on opposite sides of the groove;

a striker spring located at the groove:

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

a first stop attached to the ratchet and adapted to cooperate with the housing to limit rotation of the ratchet upon downward movement of the striker in the groove;

a second stop attached to the ratchet and adapted to cooperate with the housing to limit rotation of the ratchet upon upward movement of the striker out of the groove; and wherein the striker spring is positioned at the groove to be directly engaged by the striker when the ratchet is in the locked position.

17. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

first and second springs biasing the pawl and the ratchet in opposite directions of rotation; and wherein the striker spring is positioned at the groove to be directly engaged by the striker when the ratchet is in the locked position.

18. The latching mechanism of claim 17 wherein the striker spring is substantially in-line with a path of the striker into the groove.

19. The latching mechanism of claim 18 wherein the striker spring is a helical coil compression spring.

20. A latching mechanism for selectively retaining a closure having a striker, the latching mechanism comprising, in combination:

a housing forming a vertically extending groove for receiving the striker;

first and second axles located on opposite sides of the groove;

a striker spring located at the groove;

wherein the striker spring is a helical coil compression spring;

a pawl pivotable about the first axle and defining a notch;

a ratchet pivotable about the second axle and defining a protrusion adapted to cooperate with the notch of the pawl to selectively retain the ratchet in a locked position, the ratchet also defining a pocket for receiving the striker and retaining the striker in the groove when the ratchet is in the locked position;

spring members biasing the pawl and the ratchet in opposite directions of rotation; and wherein the housing comprises a mounting bracket and a support plate attached to the mounting bracket, the support plate adapted to support the striker spring, and wherein a bottom wall of the mounting bracket cooperates with the support plate to support the striker spring.

* * * * *